US009807525B2

(12) United States Patent
van Halteren et al.

(10) Patent No.: US 9,807,525 B2
(45) Date of Patent: Oct. 31, 2017

(54) RIC ASSEMBLY WITH THURAS TUBE

(71) Applicant: Sonion Nederland B.V., Hoofddorp (NL)

(72) Inventors: Aart Zeger van Halteren, Hobrede (NL); Thomas A. Cohen-Stuart, Amsterdam (NL)

(73) Assignee: Sonion Nederland B.V., Hoofddorp (NL)

( * ) Notice: Subject to any disclaimer, the term of this patent is extended or adjusted under 35 U.S.C. 154(b) by 15 days.

(21) Appl. No.: 14/136,496

(22) Filed: Dec. 20, 2013

(65) Prior Publication Data

US 2014/0177892 A1 Jun. 26, 2014

Related U.S. Application Data

(60) Provisional application No. 61/740,936, filed on Dec. 21, 2012.

(51) Int. Cl.
*H04R 25/00* (2006.01)
*H04R 1/10* (2006.01)

(52) U.S. Cl.
CPC ..... *H04R 25/658* (2013.01); *H04R 25/48* (2013.01); *H04R 1/1016* (2013.01); *H04R 25/65* (2013.01); *H04R 25/652* (2013.01); *H04R 25/656* (2013.01); *H04R 2201/10* (2013.01); *H04R 2225/025* (2013.01)

(58) Field of Classification Search
CPC .. H04R 25/658; H04R 1/2846; H04R 1/2838; H04R 1/2815; H04R 25/48; H04R 1/22; H04R 25/652; H04R 1/10
USPC ..... 381/349–351, 322, 23.312, 23.1
See application file for complete search history.

(56) References Cited

U.S. PATENT DOCUMENTS 1,869,178 A * 7/1932 Thuras ..... H04R 1/2819 181/160
5,606,621 A * 2/1997 Reiter ..... H04R 25/456 381/328
5,729,605 A * 3/1998 Bobisuthi ..... H04R 1/225 379/430
6,785,395 B1 8/2004 Arneson et al.
6,788,796 B1 9/2004 Miles et al.
6,831,577 B1 12/2004 Furst
6,853,290 B2 2/2005 Jorgensen et al.
(Continued)

FOREIGN PATENT DOCUMENTS

CN 201063832 * 6/2007 ..... H04R 1/10
CN 201063832 * 5/2008 ..... H04R 1/10

OTHER PUBLICATIONS

European Search Report corresponding to co-pending European Patent Application Serial No. 13198940, European Patent Office, dated Mar. 28, 2014; (2 pages).

*Primary Examiner* — Davetta W Goins
*Assistant Examiner* — Oyesola C Ojo
(74) *Attorney, Agent, or Firm* — Nixon Peabody LLP

(57) ABSTRACT

A hearing aid assembly comprising a receiver comprising a front chamber and a back chamber being acoustically coupled to respective front and back chamber openings, and acoustical guiding means for guiding air from at least one of the front and back chamber openings to an air mixing zone for mixing air from the front and back chamber openings. The mixing of air from the front and back chambers enhances the low-frequency response of the hearing aid assembly.

12 Claims, 6 Drawing Sheets

(56) References Cited

U.S. PATENT DOCUMENTS 6,859,542 B2 2/2005 Johannsen et al.
6,888,408 B2 5/2005 Furst et al.
6,914,992 B1 7/2005 van Halteren et al.
6,919,519 B2 7/2005 Ravnkilde et al.
6,930,259 B1 8/2005 Jorgensen et al.
6,943,308 B2 9/2005 Ravnkilde et al.
6,974,921 B2 12/2005 Jorgensen et al.
7,008,271 B2 3/2006 Jorgensen
7,012,200 B2 3/2006 Moller
7,062,058 B2 6/2006 Steeman et al.
7,062,063 B2 6/2006 Hansen et al.
7,072,482 B2 7/2006 Van Doorn et al.
7,088,839 B2 8/2006 Geschiere et al.
7,110,560 B2 9/2006 Stenberg
7,136,496 B2 11/2006 van Halteren et al.
7,142,682 B2 11/2006 Mullenborn et al.
7,181,035 B2 2/2007 van Halteren et al.
7,190,803 B2 3/2007 van Halteren
7,206,428 B2 4/2007 Geschiere et al.
7,221,767 B2 5/2007 Mullenborn et al.
7,221,769 B1 5/2007 Jorgensen
7,227,968 B2 6/2007 van Heltren et al.
7,239,714 B2 7/2007 de Blok et al.
7,245,734 B2 7/2007 Niederdraenk
7,254,248 B2 8/2007 Johannsen et al.
7,286,680 B2 10/2007 Steeman et al.
7,292,700 B1 11/2007 Engbert et al.
7,292,876 B2 11/2007 Bosh et al.
7,336,794 B2 2/2008 Furst et al.
7,376,240 B2 5/2008 Hansen et al.
7,403,630 B2 7/2008 Jorgensen et al.
7,415,121 B2 8/2008 Mögelin et al.
7,425,196 B2 9/2008 Jorgensen et al.
7,460,681 B2 12/2008 Geschiere et al.
7,466,835 B2 12/2008 Stenberg et al.
7,492,919 B2 2/2009 Engbert et al.
7,548,626 B2 6/2009 Stenberg et al.
7,657,048 B2 2/2010 van Halteren et al.
7,684,575 B2 3/2010 van Halteren et al.
7,706,561 B2 4/2010 Wilmink et al.
7,715,583 B2 5/2010 Van Halteren et al.
7,728,237 B2 6/2010 Pedersen et al.
7,809,151 B2 10/2010 Van Halteren et al.
7,822,218 B2 10/2010 Van Halteren
7,899,203 B2 3/2011 Van Halteren et al.
7,912,240 B2 3/2011 Madaffari et al.
7,946,890 B1 5/2011 Bondo et al.
7,953,241 B2 5/2011 Jorgensen et al.
7,961,899 B2 6/2011 Van Halteren et al.
7,970,161 B2 6/2011 van Halteren
8,098,854 B2 1/2012 van Halteren et al.
8,101,876 B2 1/2012 Andreasen et al.
8,103,039 B2 1/2012 van Halteren et al.
8,160,290 B2 4/2012 Jorgensen et al.
8,170,249 B2 5/2012 Halteren
8,189,804 B2 5/2012 Hruza
8,189,820 B2 5/2012 Wang
8,223,996 B2 7/2012 Beekman et al.
8,233,652 B2 7/2012 Jorgensen et al.
8,259,963 B2 9/2012 Stenberg et al.
8,259,976 B2 9/2012 van Halteren
8,259,977 B2 9/2012 Jorgensen et al.
8,280,082 B2 10/2012 van Halteren et al.
8,284,966 B2 10/2012 Wilk et al.
8,313,336 B2 11/2012 Bondo et al.
8,315,422 B2 11/2012 van Halteren et al.
8,331,595 B2 12/2012 van Halteren
8,369,552 B2 2/2013 Engbert et al.
8,379,899 B2 2/2013 van Halteren et al.
8,509,468 B2 8/2013 van Halteren et al.
8,526,651 B2 9/2013 Lafort et al.
8,526,652 B2 9/2013 Ambrose et al.
9,301,041 B2 * 3/2016 Narayan ..... H04R 1/1083
2003/0002700 A1 * 1/2003 Fretz ..... H04R 25/65 381/330
2004/0170291 A1 9/2004 Eaton
2007/0291971 A1 * 12/2007 Halteren ..... H04R 25/48 381/322
2009/0147981 A1 * 6/2009 Blanchard ..... H04R 1/1075 381/380
2009/0154755 A1 * 6/2009 Yamagishi ..... H04R 1/2819 381/382
2010/0061582 A1 * 3/2010 Takigawa ..... H04R 1/345 381/380
2010/0166245 A1 * 7/2010 Takigawa ..... H04R 1/1041 381/380
2011/0110544 A1 * 5/2011 Vestergaard ..... H04R 25/658 381/312
2011/0182453 A1 7/2011 van Hal et al.
2011/0189880 A1 8/2011 Bondo et al.
2011/0299708 A1 12/2011 Bondo et al.
2011/0299712 A1 12/2011 Bondo et al.
2011/0311069 A1 12/2011 Ambrose et al.
2012/0014548 A1 1/2012 van Halteren
2012/0027245 A1 2/2012 van Halteren et al.
2012/0140966 A1 6/2012 Mocking et al.
2012/0155683 A1 6/2012 van Halteren
2012/0155694 A1 6/2012 Reeuwijk et al.
2012/0255805 A1 10/2012 van Halteren et al.
2013/0028451 A1 1/2013 de Roo
2013/0136284 A1 5/2013 van Hal et al.
2013/0142370 A1 6/2013 Engbert et al.
2013/0163799 A1 6/2013 Van Halteren
2013/0195295 A1 8/2013 van Halteren et al.

* cited by examiner

RIC ASSEMBLY WITH THURAS TUBE

CROSS-REFERENCE TO RELATED APPLICATION

This application claims the benefit of U.S. Provisional Patent Application No. 61/740,936, filed Dec. 21, 2012, entitled "RIC Assembly with Thuras Tube" which is hereby incorporated by reference in its entirety.

FIELD OF THE INVENTION

The present invention relates to a hearing aid assembly. In particular, the present invention relates to a so-called receiver in the canal (RIC) hearing aid assembly having an enhanced low-frequency performance.

BACKGROUND OF THE INVENTION

It is well-known that traditional receivers applying domes with holes exhibit a significantly reduced low-frequency response due to the low frequency filtering characteristics of the holes in the dome.

A direct comparison between frequency responses of a closed dome and an open dome is shown in FIG. 1. It is evident that the sound pressure level (SPL) of the closed dome is significantly higher that the SPL of the open dome in the frequency range from 100 Hz to 2 kHz.

In view of the above-mentioned lack of low-frequency performance it may be seen as an object of embodiments of the present invention to provide a receiver arrangement for a hearing aid assembly, said receiver arrangement enhancing the low-frequency response for receivers applying an open dome arrangement.

SUMMARY OF INVENTION

The above-mentioned object is complied with by providing, in a first aspect, a hearing aid assembly comprising

- a receiver comprising a front chamber and a back chamber being acoustically coupled to respective front and back chamber openings, and
- acoustical guiding means for guiding air from at least one of the front and back chamber openings to an air mixing zone for mixing air from the front and back chamber openings.

It is an advantage of the present invention that the suggested mixing of air from the front and back chambers in the air mixing zone increases the low-frequency performance of the hearing aid assembly. In case of a full range receiver, the frequency performance is increased for the low frequencies of the full range. In case of a tweeter i.e. high frequency receiver, the frequency performance is increased for the low frequencies of the high-frequency range.

The hearing aid assembly may form part of a RIC hearing aid where the above-mentioned assembly is adapted to be positioned in the ear canal whereas other parts of the RIC hearing aid, such as battery, microphone etc., may be positioned outside the ear canal.

The receiver may be a balanced armature-type receiver. However, other types of receivers having front and back chambers may be applicable as well.

The air mixing zone may form part of an air mixing chamber which may be acoustically coupled to a sound outlet of the assembly. The sound outlet of the hearing air assembly may comprise a dome.

In an embodiment of the invention the front chamber opening may form part of the air mixing zone. The acoustical guiding means may thus be coupled to the back chamber opening so as to guide air from the back chamber opening to the air mixing zone. The air mixing zone may be in direct acoustical contact with the dome of the sound outlet of the hearing aid assembly in that the dome may form part of the boundaries of the air mixing zone.

When air from the back chamber opening arrives at the air mixing zone it has been phase-shifted and delayed compared to the air from the front chamber opening. The introduced phase-shift is caused by the fact that air from the front chamber opening is generated when the receiver membrane moves in one direction, whereas air from the back chamber opening is generated when the receiver membrane moves in the opposite direction.

The acoustical guiding means may comprise a tube, such as a flexible duct, having a predetermined length and a predetermined inner diameter. The tube may show a low-pass frequency behaviour because high-frequency components (above 3 kHz) are typically damped by the tube geometry.

Various predetermined lengths and inner diameters have been tested in order to optimise the low-frequency response of the hearing aid assembly. Thus, the length of the tube may be selected in accordance with the relevant frequencies in order to utilize the acoustical resonance of the tube.

As a result of the tests the predetermined length and the predetermined inner diameter of the tube may typically fall within the ranges 20-100 mm, such as 3-80 mm and 0.5-1.0 mm, such as 0.25-0.75 mm, respectively. However, other tube dimensions may be applicable as well.

At least one electrical connector adapted to connect the receiver to exterior electrical components of the hearing aid assembly may be provided. Such exterior electrical components may involve batteries, amplifiers, microphones etc.

It may be advantageous from a space saving perspective to position one or more electrical wires interconnecting the receiver and the at least one electrical connector at least partly within the acoustical guiding means. In this way vulnerable free-hanging electrical wires between the receiver and the electrical connector can be avoided.

BRIEF DESCRIPTION OF THE DRAWINGS

The present invention will now be explained in further details with reference to the accompanying figures where.

Figure 1:
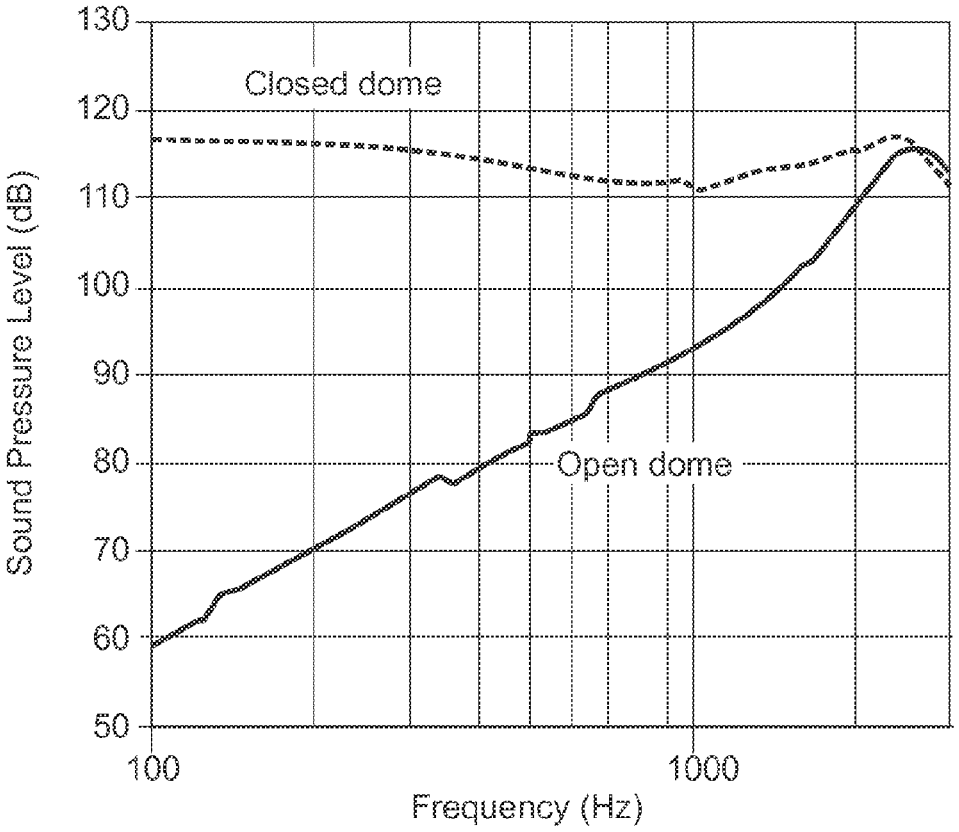
Fig. 1 (Prior Art)
FIG. 1 shows frequency responses between a closed dome and an open dome.

While the invention is susceptible to various modifications and alternative forms, specific embodiments have been shown by way of examples in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its most general aspect the present invention relates to a hearing aid assembly, such as a RIC hearing aid assembly, where air from a receiver's back chamber is mixed with air from the receiver's front chamber. This mixing of air from the two chambers enhances the low-frequency response of the hearing air assembly significantly. An increase of around 6 dB in SPL may be achieved; or even more. Acoustical guiding means, such as a flexible tube, is provided for guiding air from the back chamber to a mixing zone in the form of a chamber where also air from the front chamber is present. The mixed air drives a sound outlet dome of the overall hearing aid assembly. The length and the diameter of the acoustical guiding means influence the low-frequency performance of the hearing aid assembly.

Figure 2:
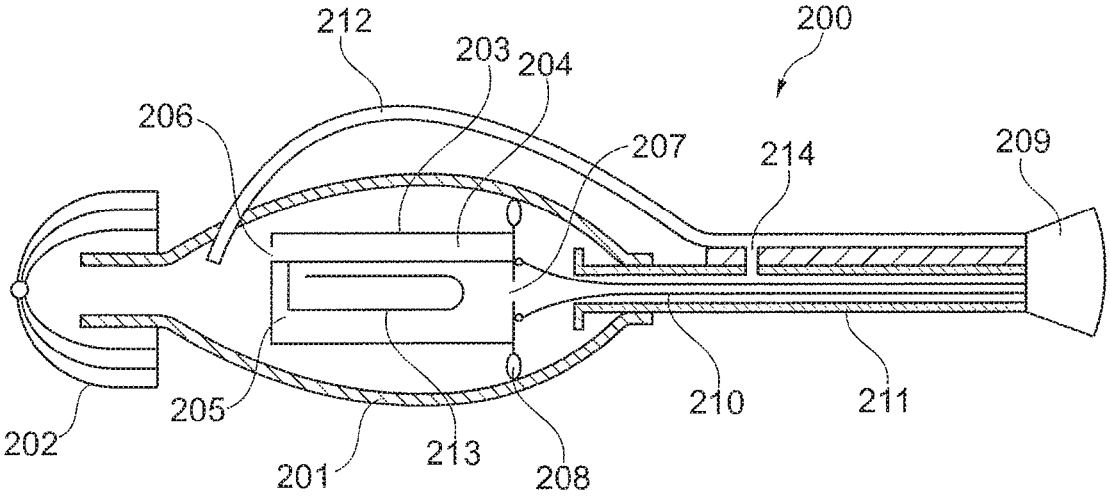
FIG. 2 shows a cross-sectional view of a RiC part of a hearing aid assembly according the present invention.

Referring now to FIG. 2 a hearing aid assembly 200 according to the present invention is depicted. The assembly comprises a body 201 and a sound outlet dome 202 attached thereto. The body houses a receiver 203 having a front chamber 204 and a back chamber 205. Pressurized air may escape from the two chambers via respective sound openings 206 (front chamber) and 207 (back chamber). An acoustical seal 208 is provided between the receiver and the body 201 in order to avoid uncontrolled mixing of air from the two chambers. The receiver is electrically coupled to the connector 209 via electrical wires 210. The connector 209 ensures that the receiver can be electrically connected to exterior parts, such as a behind-the-ear (BTE) part, of the hearing aid.

A tube section 211 is provided between the body 201 and the connector 209. This tube section 211 forms an acoustical channel where pressurized air from the back chamber opening 207 is allowed to enter and propagate. An additional tube section 212 and a passage 214 are provided for leading pressurized air to a mixing zone near the front chamber opening 206 so that air from the front and back chamber openings 206, 207 are mixing in order to enhance the low-frequency response of the hearing aid assembly 200. The air arriving from the back chamber opening 207 is in phase when it blends with air leaving the front chamber opening 206.

When air from the back chamber opening 207 is guided to the mixing zone behind the sound outlet dome 202 the low-frequency performance of the assembly is highly improved in that the SPL in the low-frequency range, typically below 2 kHz, is increased significantly.

The high-frequency performance of the hearing aid assembly is primarily dominated by sound escaping from the front chamber opening of the receiver. The tube sections 211, 212 act as a low-pass filter having a cut-off frequency of around 3 kHz. Thus, essentially no high-frequency components are allowed to pass through the tube sections 211, 212.

Thus, it is advantageous that the increased low-frequency performance caused by the air from the back chamber opening does not influence the average high-frequency performance of the assembly in any particular way.

The receiver 203 shown in FIG. 2 is a balanced armature-type receiver. However, other types of receivers having front and back chambers may be applicable as well.

Figure 3:
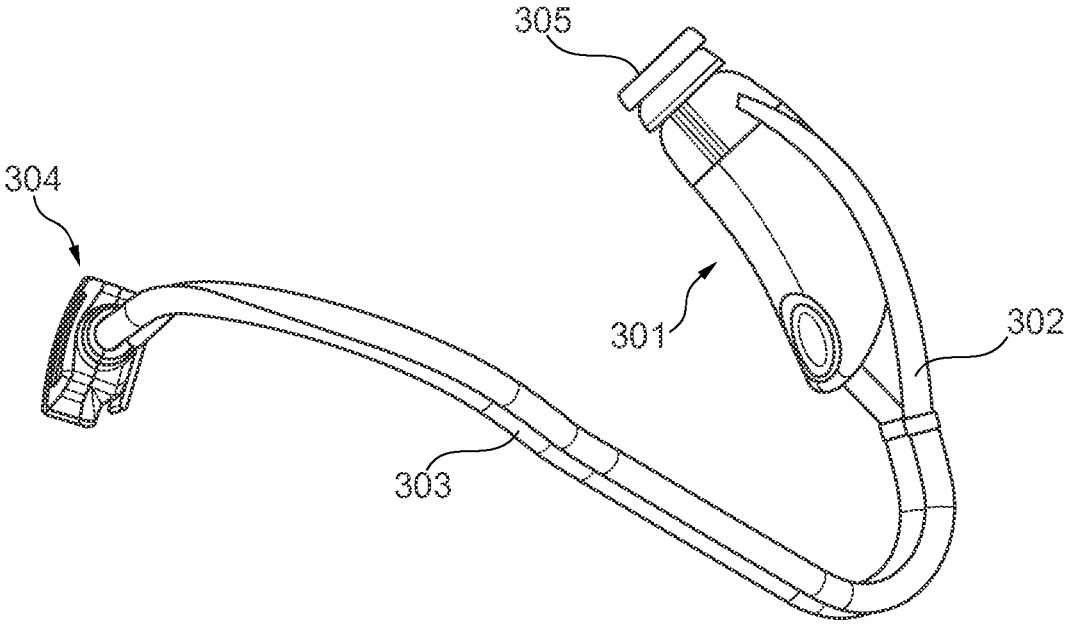
FIG. 3 shows a three-dimensional illustration of a RiC part of a hearing aid assembly according the present invention.

A three-dimensional illustration of the RiC part of a hearing aid assembly is shown in FIG. 3. The hearing aid assembly comprises a body 301 housing the receiver (not shown) and the connector 304 interconnected by the tubes 302 and 303. The tube 302 is leading air from the back chamber of the receiver to the air mixing chamber behind the sound outlet 305. The tube 303, which also serves as an air guiding passage, contains electrical wires interconnecting the receiver (not shown) and the connector 304.

Figure 4:
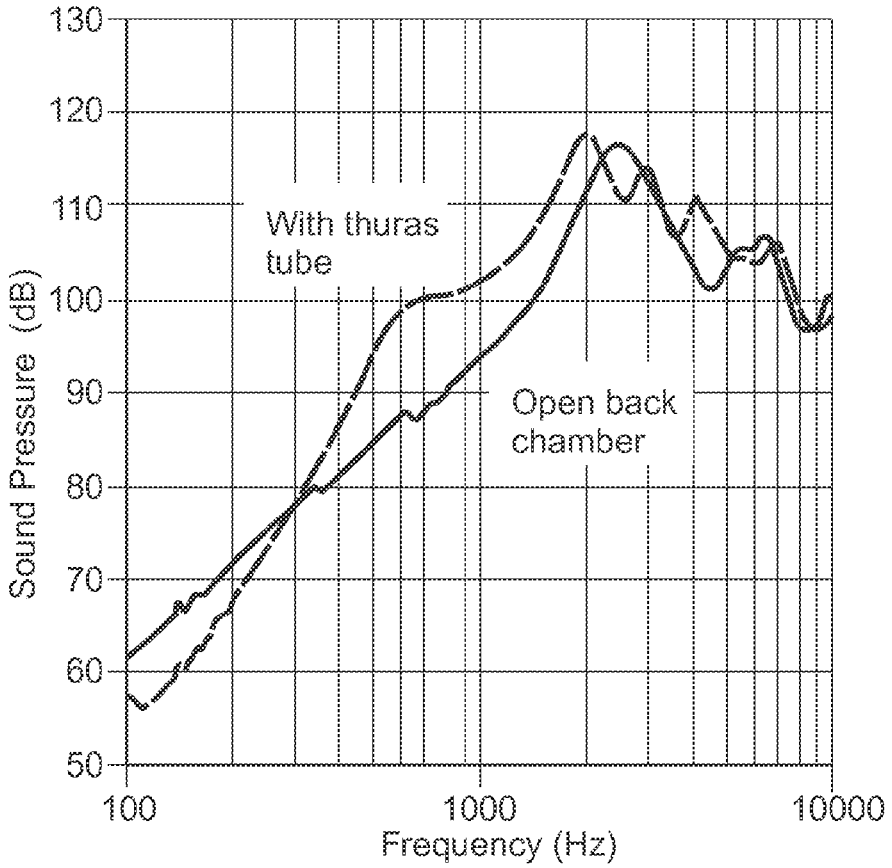
FIG. 4 shows a comparison between an open back chamber and the appliance of a thuras tube.

FIG. 4 shows a comparison of the SPL from a receiver having an open back chamber and a similar receiver being equipped with a tube which in the following is denoted a thuras tube. As seen in FIG. 4 the thuras tube increases the SPL in the frequency range from around 300 Hz to around 2 kHz. The thuras tube used in connection with the results presented in FIG. 4 has a length of 90 mm and an inner diameter of 0.75 mm.

Figure 5:
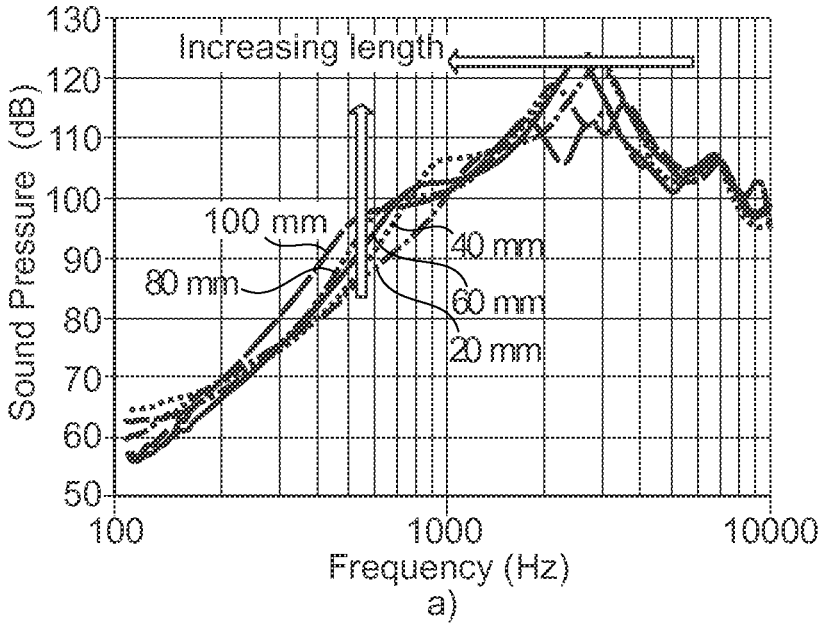
FIG. 5 illustrates the influence of thuras tube length and diameter.
Figure 5:
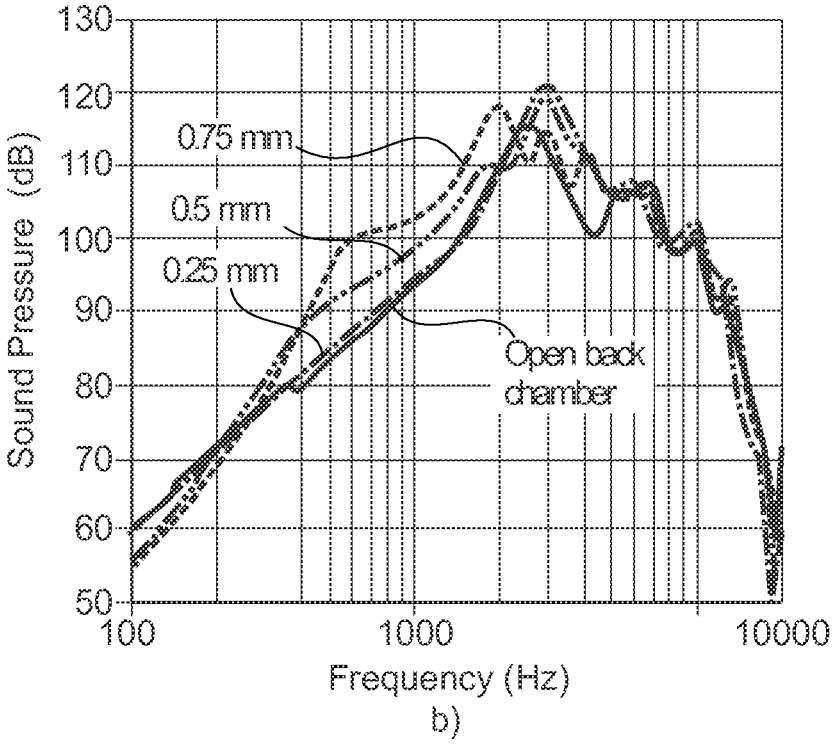

FIG. 5*a* shows the achievable SPL for various lengths of the thuras tubes. The tendency is clear in that the low-frequency response increases with increasing length of the thuras tube. Also, maximum SPL seems to shift towards lower frequencies with increasing length.

FIG. 5*b* shows the achievable SPL for various tube diameters. As seen in FIG. 5*b*, an optimal low-frequency performance seems to exist for tube diameters of around 0.75 mm where the low-frequency response is maximal in terms of achievable SPL, at least in the frequency range 300 Hz to around 2 kHz.

Figure 6:
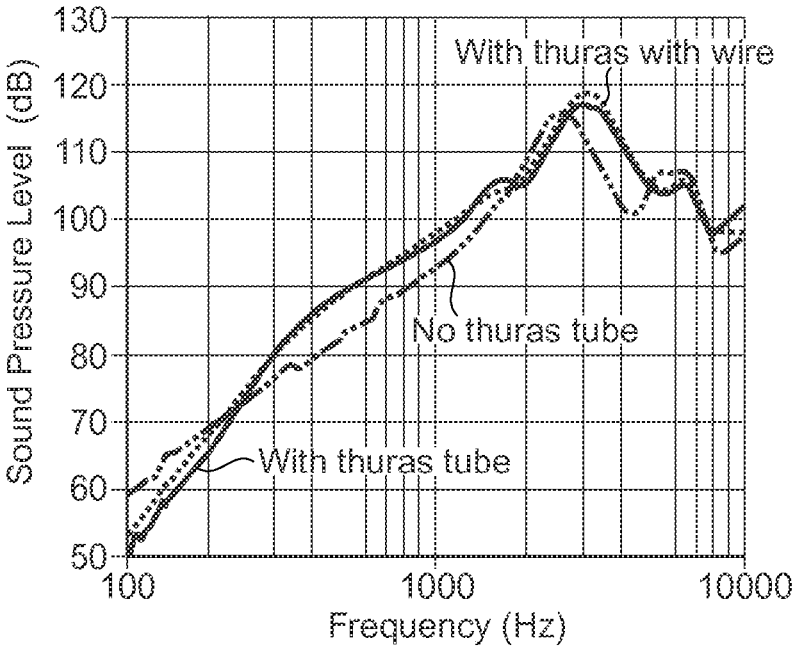
FIG. 6 shows the influence of having electrical wires arranged in the thuras tube.

FIG. 6 illustrates that the acoustical performance of the hearing aid assembly is essentially not influenced by the presence of electrical wires being arranged in at least part of the thuras tubes. For comparison, the frequency response of a traditional receiver having no thuras tube is shown as well. As seen in FIG. 6 the traditional receiver shows a lower SPL (up to around 6-7 dB) in the frequency range 250 Hz to around 2 kHz.

Figure 7:
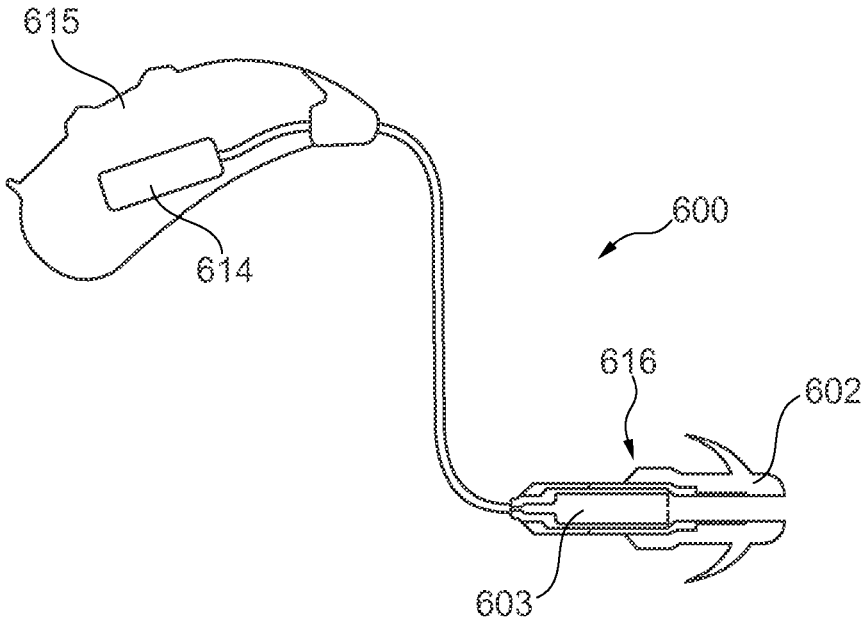
FIG. 7 shows a schematic cross-section of a RiC hearing aid assembly according to the invention.

Another embodiment of the invention is shown in FIG. 7. This shows a RiC hearing aid assembly 600 comprising a low-frequency receiver 614 and a high-frequency receiver 604, e.g. applicable as a woofer—tweeter receiver combination for HiFi purposes. The woofer i.e. the low-frequency receiver 614 outputs the low frequency range, the tweeter i.e. the high-frequency receiver 603 outputs the high-frequency range of the output. The woofer is positioned in the BTE part 615 of the hearing aid, the tweeter is positioned in the RiC part 616 of the hearing aid. The sound of both receivers 603, 614 is outputted through the sound outlet dome 602.

In such a distributed system the tweeter has a peak at around 5 kHz, instead at 3 kHz common for full range receivers which is desired as it approaches the natural resonance frequency associated with the human ear. To reduce the cross-over effects associated with the split of the frequency spectra of the respective receivers, the thuras tube can be optimised to provide an increase of the low part of the high-frequency spectrum, particularly at 3 kHz. Accordingly, the the full range output of the hearing aid shows an improvement due to the frequency performance increase at 3 kHz.

The invention claimed is:

1. A hearing aid assembly comprising:

a receiver comprising a front chamber and a back chamber being acoustically coupled to respective front and back chamber openings, and acoustical guiding means for guiding air from the back chamber opening to an air mixing zone for mixing air from the front and back chamber openings, the acoustical guiding means including a flexible tube having a predetermined length and a predetermined inner diameter, the air mixing zone being acoustically coupled to a sound outlet that includes a dome, the air mixing zone including an area behind the sound outlet dome, the sound outlet dome forming part of the boundaries of the air mixing zone, wherein the predetermined length and the predetermined inner diameter of the flexible tube are within the ranges 20-100 mm and 0.25-0.75 mm, respectively.

2. A hearing aid assembly according to claim 1, wherein the front chamber opening forms part of the air mixing zone.

3. A hearing aid assembly according to claim 1, wherein the predetermined acoustical properties comprises a low-pass filter characteristic.

4. A hearing aid assembly according to claim 1, further comprising at least one electrical connector adapted to connect the receiver to exterior electrical components of the hearing aid assembly.

5. A hearing aid assembly according to claim 4, wherein one or more electrical wires interconnecting the receiver and the at least one electrical connector are at least partly provided within the acoustical guiding means.

6. A hearing aid assembly according to claim 1, wherein the acoustical guiding means is coupled to the back chamber opening so as to guide air from the back chamber opening to the air mixing zone.

7. A hearing aid assembly according to claim 2, wherein the acoustical guiding means is coupled to the back chamber opening so as to guide air from the back chamber opening to the air mixing zone.

8. A hearing aid assembly according to claim 1, further comprising at least one electrical connector adapted to connect the receiver to exterior electrical components of the hearing aid assembly.

9. A hearing aid assembly according to claim 2, further comprising at least one electrical connector adapted to connect the receiver to exterior electrical components of the hearing aid assembly.

10. A hearing aid assembly according to claim 1, further comprising at least one electrical connector adapted to connect the receiver to exterior electrical components of the hearing aid assembly.

11. A hearing aid according to claim 1, wherein the air mixing zone is in direct acoustical contact with the dome of the sound outlet of the hearing aid assembly.

12. A hearing aid according to claim 11, wherein the dome forms parts of the boundaries of the air mixing zone.

* * * * *